US006732430B1

(12) United States Patent
Murakami et al.

(10) Patent No.: US 6,732,430 B1
(45) Date of Patent: May 11, 2004

(54) METHOD OF MANUFACTURING WIRING MEMBER, AND ELECTRIC CONNECTION BOX

(75) Inventors: Masakazu Murakami, Hikone (JP); Shin Hasegawa, Hikone (JP); Tatsuo Satori, Hikone (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 155 days.

(21) Appl. No.: 09/593,005

(22) Filed: Jun. 13, 2000

(30) Foreign Application Priority Data

Jun. 17, 1999 (JP) ..... 11-171066

(51) Int. Cl.[7] ..... H01R 43/04
(52) U.S. Cl. ..... 29/866; 29/857
(58) Field of Search ..... 29/857, 861, 863, 29/865, 866, 867

(56) References Cited

U.S. PATENT DOCUMENTS 3,550,645 A * 12/1970 Keogh ..... 140/92.2
4,373,261 A * 2/1983 Long, Jr. ..... 29/861
4,549,335 A * 10/1985 Gorris et al. ..... 29/866

FOREIGN PATENT DOCUMENTS

JP 8-79943 3/1996

* cited by examiner

*Primary Examiner*—Richard Chang
(74) *Attorney, Agent, or Firm*—Oblon, Spivak, McClelland, Maier & Neustadt, P.C.

(57) ABSTRACT

A method of manufacturing a wiring member including winding an electric wire into a desired pattern in a set of wire holding members, each of the wire holding members inserted into a rotary shaft and containing a plurality of wire retaining sections; cutting the electric wire at a desired position; and removing the electric wire and wire holding members from the wire winding body.

6 Claims, 19 Drawing Sheets

METHOD OF MANUFACTURING WIRING MEMBER, AND ELECTRIC CONNECTION BOX

BACKGROUND OF THE INVENTION

1. Field of the Invention

The present invention relates to a method of manufacturing a wiring member and an electric connection box which uses a wiring member manufactured by this method.

2. Description of the Related Art

In an electric connection box, an electric wire is wired, one at a time, on a wiring plate, which is formed of an electrically insulating synthetic resin and has a plurality of projections between which an electric wire is laid out, and is cut and those works are repeated to form a wiring member having a circuit of a desired pattern. For example, Japanese Unexamined Patent Publication (KOKAI) No. Hei 8-79943 discloses a wiring method for a wiring member assembly, which places a wiring member, acquired in the above-described manner, on a wiring board having a bus bar, and pressing the electric wire in slots of pressure-contacting terminals provided on the bus bar by a pressing jig, thereby forming an internal circuit of an electric connection box.

The wiring member assembly disclosed in the publication is acquired by repeating the works of wiring an electric wire on a wiring member one at a time and cutting the electric wire as in the above-described wiring member acquisition. The wiring work for a wiring member assembly takes time and thus manufacturing the wiring member assembly also takes time. Accordingly, the manufacture of an electric connection box takes time, disadvantageously.

As an electric wire is wired one at a time to form a circuit of a desired pattern, the wiring head of a wiring machine which holds the electric wire should be designed to be movable three-dimensionally in order to cope with complicated circuit patterns. The wiring machine inevitably has a complex structure and becomes expensive, which makes a wiring member assembly and thus an electric connection box expensive.

Further, as the structure of the wiring member becomes complex, a wiring program for wiring electric wires becomes more elaborate. What is more, a wiring plate is a special component whose outer shape matches with each type of electric connection box. Those factors make it difficult to cope with a change in the design of a circuit in an electric circuit box.

SUMMARY OF THE INVENTION

Accordingly, it is an object of the present invention to provide a method of manufacturing a wiring member and an electric connection box, which allow a wiring member to be manufactured in a short period of time using a wiring machine with a simple structure without using a special wiring plate and which can easily cope with a change in circuit design.

To achieve the above object, a method of manufacturing a wiring member according to this invention comprises the steps of winding an electric wire around a wire winding body having a plurality of wire holding members arranged thereon, and wiring the electric wire into a desired pattern using a plurality of retaining sections formed on each of the wire holding members; cutting the electric wire at a desired position; and removing the electric wire at least from the wire winding body.

It is preferable that a rotary shaft and a plurality of inserting sections where the wire holding members are inserted should be formed on the wire winding body.

It is preferable that the retaining sections be retaining grooves.

It is further preferable that each of the wire holding member should have a terminal groove formed in a direction perpendicular to a layout direction of the plurality of retaining grooves.

To achieve the object of this invention, an electric connection box according to this invention is manufactured by retaining a wiring member manufactured by the above-described method recited in a case.

It is preferable that the case should have an upper case and a lower case.

According to the present invention, there are provided a method of manufacturing a wiring member and an electric connection box, which allow a wiring member to be manufactured in a short period of time using a wiring machine with a simple structure without using a special wiring plate and which can easily cope with a change in circuit design.

The aforementioned object of this invention, together with other objects, features and advantages thereof, will be readily apparent from the following description with reference to the accompanying drawings.

DETAILED DESCRIPTION OF THE PREFERRED EMBODIMENTS

Figure 1:
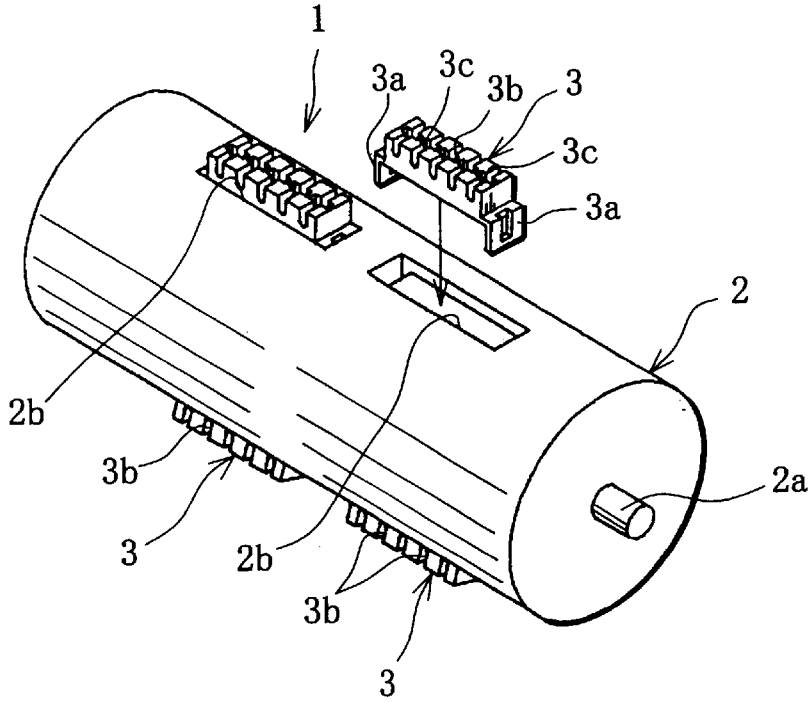
FIG. 1 is a perspective view illustrating the schematic structure of a wiring machine to which a method of manufacturing a wiring member according to this invention is adapted.

Preferred embodiments of a method of manufacturing a wiring member and an electric connection box according to the present invention will now be described referring to FIGS. 1 through 34.

First, a description will be given of a wiring machine which is used at the time of manufacturing a wiring member of this invention. A wiring machine 1 has a wire winding body 2 having a rotary shaft 2*a* and a plurality of inserting sections 2*b* formed therein where wire holding members 3 are respectively inserted. The wiring machine 1 also has a wiring head 4 (see FIG. 2) located above the wire winding body 2. The wiring head 4 wires an electric wire 5 to be discussed later in a one-stroke drawing style. The rotation of the wire winding body 2 and the operation of the wiring head 4, etc. are controlled by unillustrated control means.

Figure 2:
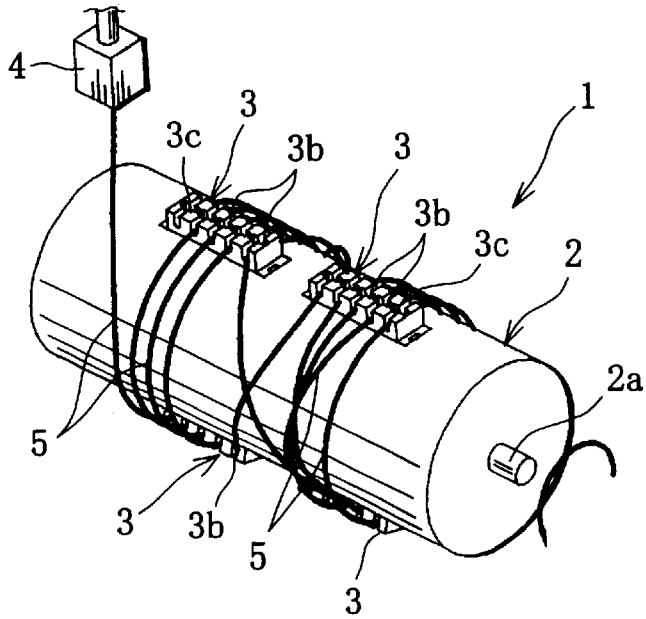
FIG. 2 is a perspective view showing a step of wiring an electric wire into a desired pattern using the wiring machine in FIG. 1.

The wire winding body 2 is rotated about the rotary shaft 2*a* in the direction of the arrow in FIG. 2 by unillustrated drive means. It is to be noted that the wire winding body 2 can rotate in the reverse direction at a desired position to wire the electric wire 5 in a U form depending on the circuit pattern.

Each wire holding member 3 has engagement pieces 3*a* respectively formed on both sides and a plurality of retaining grooves 3*b* formed widthwise, with a terminal groove 3*c* formed in the center and traversing the individual retaining grooves 3*b*.

The wiring head 4 is movable in the axial direction of the rotary shaft 2*a*. In accordance with the rotation of the wire winding body 2, the wiring head 4 draws out the electric wire 5 from an unillustrated drum and feeds it out to the wire winding body 2.

In manufacturing a wiring member, first, the wire holding members 3 are inserted in the respective inserting sections 2*b* of the wire winding body 2 and the electric wire 5 is fed out from the wiring head 4 while rotating the wire winding body 2 in the direction of the arrow as shown in FIG. 2. Accordingly, the wiring machine 1 winds the electric wire 5, fed out from the wiring head 4, around the wire winding body 2 in a one-stroke drawing style and wires the electric wire 5 into a desired pattern by retaining the electric wire using the retaining grooves 3*b* of each wire holding member 3 while moving the wiring head 4 in the axial direction of the rotary shaft 2*a*.

Figure 3:
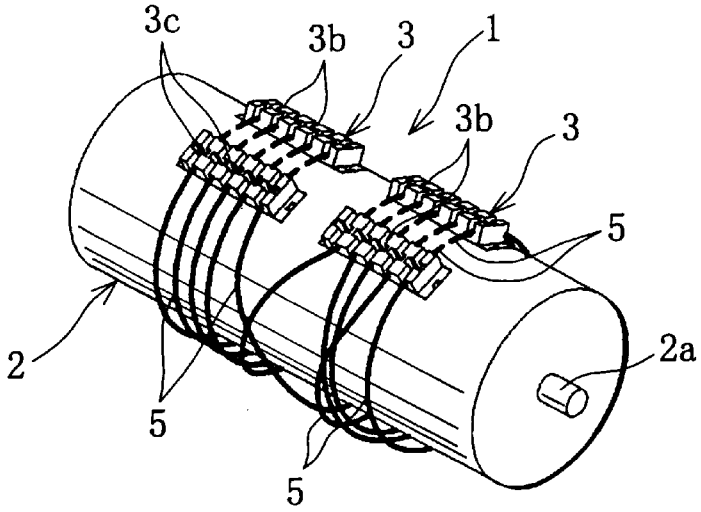
FIG. 3 is a perspective view showing a step of cutting the electric wire, wired into the desired pattern, at a desired position using the wiring machine in FIG. 1.

When wiring the electric wire 5 into a desired pattern by winding the electric wire 5 around the wire winding body 2 is completed, the electric wire 5 is cut at a desired position, e.g., in the vicinity of the wire holding members 3 as shown in FIG. 3.

Figure 4:
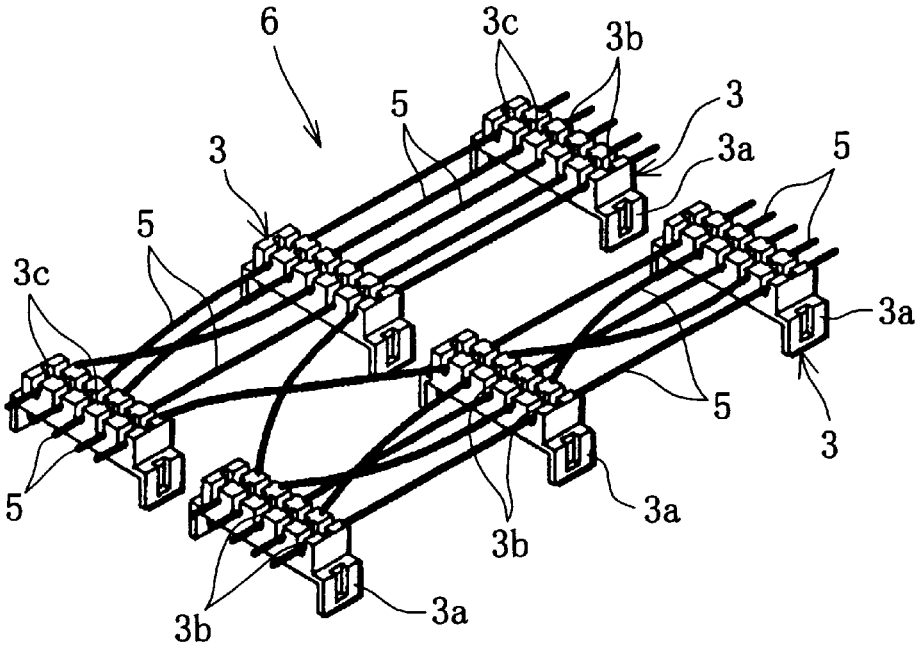
FIG. 4 is a perspective view of a wiring member which is manufactured through a step of cutting the electric wire at a desired position and removing the electric wire from a wire winding body.

Then, the electric wire 5 is removed together with the wire holding members 3 from the wire winding body 2, thus yielding a wiring member 6 shown in FIG. 4 which has the electric wire 5 wired into the desired pattern.

According to the method of this invention, as described above, the electric wire 5 is wound around the wire winding body 2 having a plurality of wire holding members 3 arranged thereon and the wiring head 4 is moved in the axial direction of the rotary shaft 2*a*. According to this method, after the electric wire 5 is retained in a plurality of retaining grooves 3*b* formed in each wire holding member 3 and wired into a desired pattern and is cut at a desired position, the electric wire 5 is removed together with the wire holding members 3 from the wire winding body 2, thus yielding the wiring member 6. This method can therefore manufacture the wiring member 6 in a short period of time by using the wiring machine 1 having a simple structure, without requiring any special wiring plate, and can easily cope with a change in circuit design.

The wiring member 6 manufactured in the above manner is installed in an electric connection box in the following manner.

Figure 5:
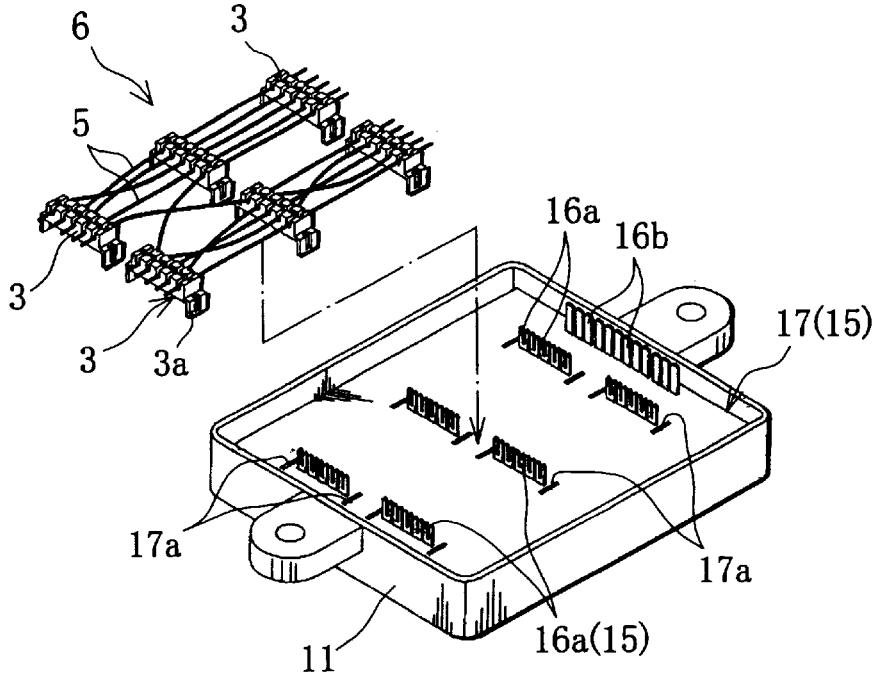
FIG. 5 is a perspective view depicting a step of installing the wiring member in FIG. 4 into the upper case of an electric connection box.

First, as shown in FIG. 5, the wiring member 6 is placed in an upper case 11 where a bus-bar wiring member 15 which has a plurality of bus bars 16 (not shown) and a plurality of insulating plates 17 stacked has been accommodated in advance. At this time, a plurality of pressure-contacting terminals 16*a* and tab terminals 16*b* of each bus bar 16 protrude from the associated insulating plate 17 at adequate positions, and the insulating plate 17 has inserting holes 17*a* formed in the vicinity of those pressure-contacting terminals 16*a*. The engagement pieces 3*a* of the wire holding members 3 are to be pressed in the respective inserting holes 17*a*. The upper case 11 is a flat box with attachment brackets 11*a* formed outside, and is to be fitted over a lower case 12 to be discussed later.

Figure 6:
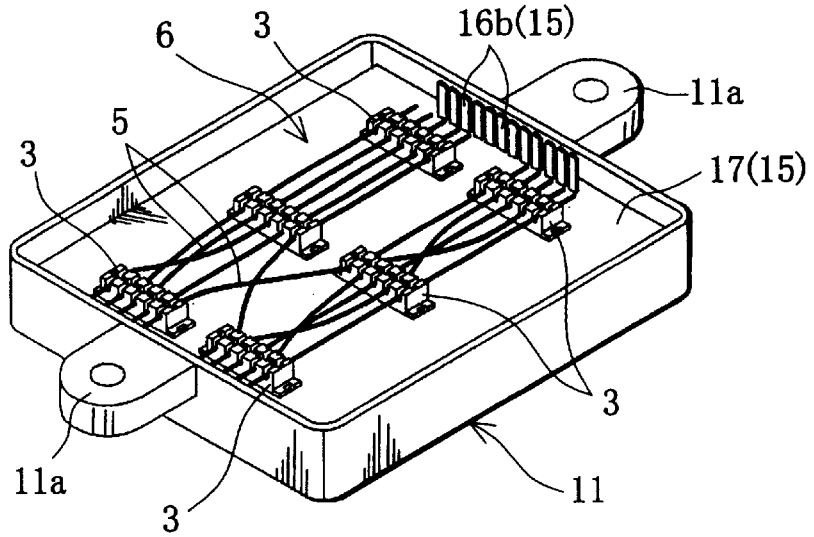
FIG. 6 is a perspective view showing the wiring member in FIG. 4 installed into the upper case of the electric connection box.

As the individual engagement pieces 3*a* of a plurality of wire holding members 3 are pressed into the respective inserting holes 17*a* and attached to the bus-bar wiring member 15, therefore, the individual pressure-contacting terminals 16*a* are fitted into the respective terminal grooves 3*c* of the wire holding members 3 so that the associated bus bars 16 are connected to the electric wires 5 and the wiring member 6 is retained in the upper case 11, as shown in FIG. 6.

At this time, the individual electric wires 5 are pressed one by one from above with a proper jig so as to be surely connected to the respective pressure-contacting terminals 16*a*. The individual electric wires 5 may be connected to the respective pressure-contacting terminals 16*a* by pressure-contacting or the like. As each wire holding member 3 is attached by pressing the individual engagement pieces 3*a* into the respective inserting holes 17*a* of the insulating plate 17, it can prevent the wiring member 6 from being improperly attached to the bus-bar wiring member 15 due to warping of the insulating plate 17 or other external force.

Figure 7:
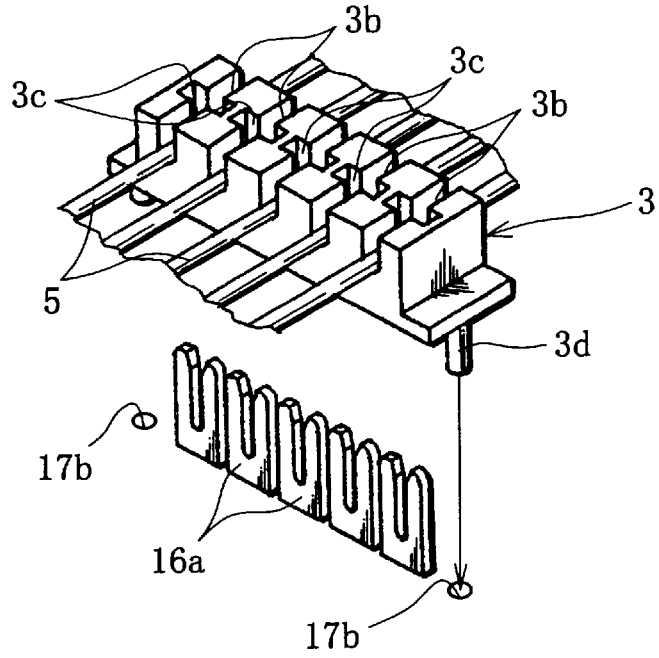
FIG. 7 is an enlarged perspective view of essential portions illustrating another mode of installing the wiring member in FIG. 4 into the upper case of an electric connection box.

The engagement pieces 3*a* of the wire holding member 3 used in the wiring member 6 may be replaced with protruding bosses 3*d* which engage with engagement holes 17*b* formed in the insulating plate 17 as shown in FIG. 7.

Figure 8:
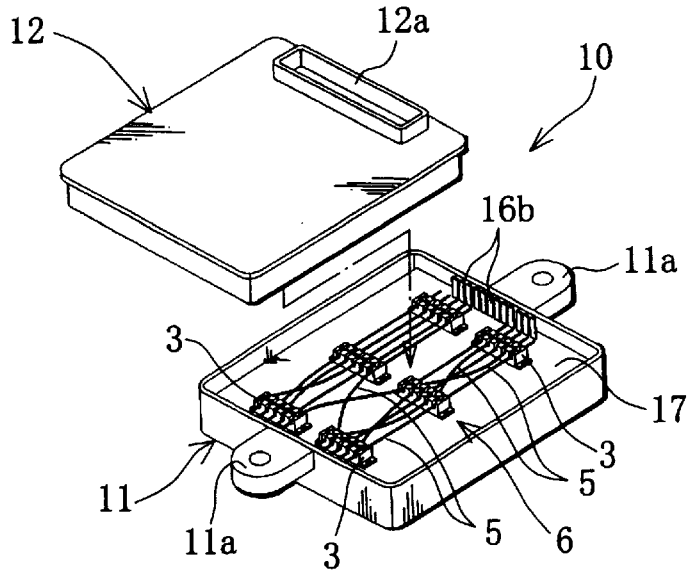
FIG. 8 is a perspective view showing how to construct an electric connection box of this invention by fitting a lower case into the upper case shown in FIG. 6 in which the wiring member has been installed.

Next, the lower case 12 is fitted into the upper case 11 retaining the wiring member 6, thus assembling an electric connection box 10 as shown in FIG. 8. The lower case 12 is a flat box and has a connector housing 12*a* formed at a position corresponding to a plurality of tab terminals 16*b* to retain those tab terminals 16*b*.

As the electric connection box 10 is constructed by placing the wiring member 6, which uses no special wiring plate and is manufactured in a short period of time using the wiring machine 1 having a simple structure, inside the upper case 11 and the lower case 12, the electric connection box 10 can easily be adapted to a change in circuit design, and can be manufactured at low cost.

Figure 9:
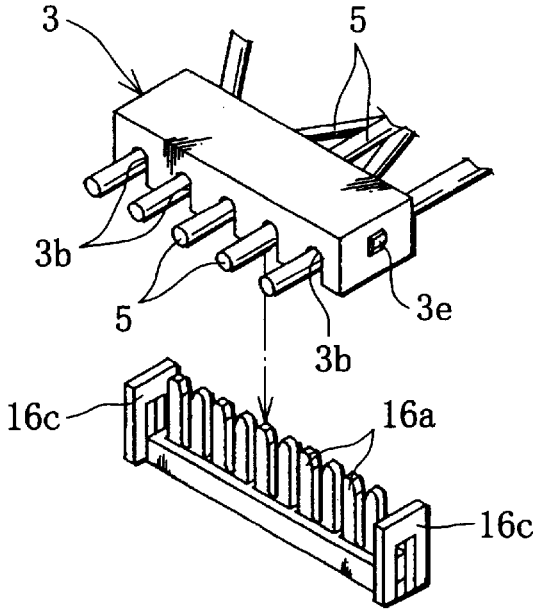
FIG. 9 is a perspective view depicting a modification of a wire holding member of a wiring member and the essential portion of the upper case shown in FIG. 5, which is used at the time of using the wire holding member.

The engagement pieces 3*a* of the wire holding member 3 used in the wiring member 6 may be replaced with engagement projections 3*e* that engage with engagement pieces 16*c* which are formed on the bus bar 16 and protrude from the insulating plate 17 as shown in FIG. 9.

Figure 10:
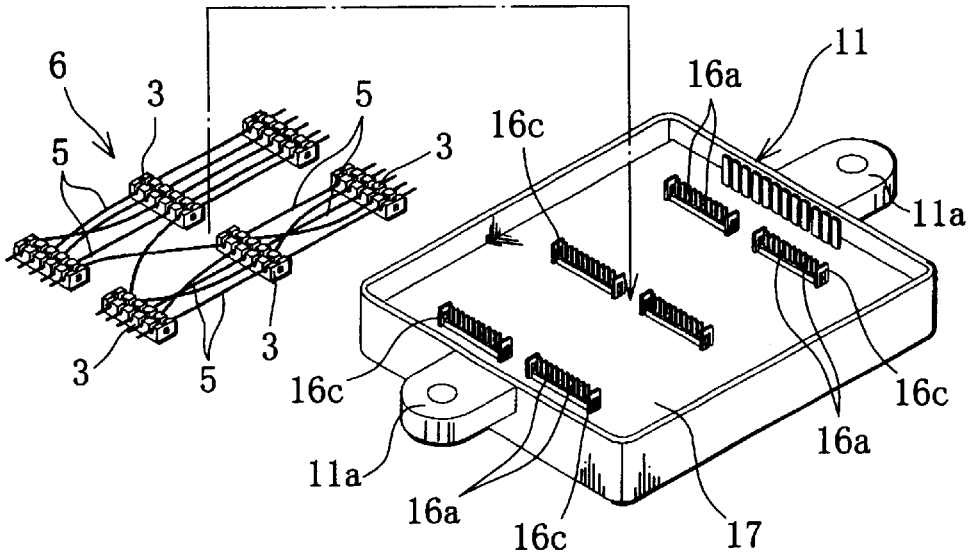
FIG. 10 is a perspective view depicting how to install a wiring member, which uses the wire holding member shown in FIG. 9, into the upper case.

In this case, the wiring member 6 is engaged, in a turned-over state, with the engagement pieces 16*c* to be attached to the insulating plate 17, as shown in FIG. 10. As a result, the pressure-contacting terminals 16*a* of the bus bars 16 are fitted into the respective terminal grooves 3*c* of the wire holding members 3 of the wiring member 6 so that the associated bus bars 16 are connected at a time by the electric wires 5. This wiring member 6, unlike the wiring member 6 shown in FIG. 6, does not require that the individual electric wires 5 be pressed into the retaining grooves 3*b* one at a time using a proper jig.

The wire holding member 3 used in the wiring member 6 may be designed in such a way that in order to prevent the electric wires 5 from coming off the retaining grooves 3*b* before the wire holding member 3 is attached to the bus-bar wiring member 15, a cover 7 (see FIG. 12) is attached to the wire holding member 3 after the electric wire 5 is wired into a desired pattern.

Figure 11:
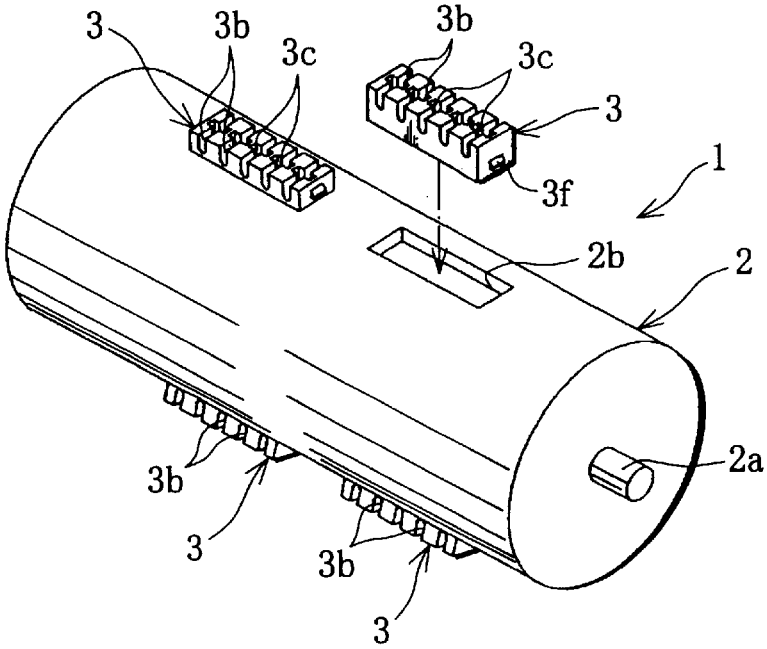
FIG. 11 is a perspective view illustrating a method of manufacturing a wiring member according to another embodiment of this invention and a wiring machine which uses another wire holding member.
Figure 12:
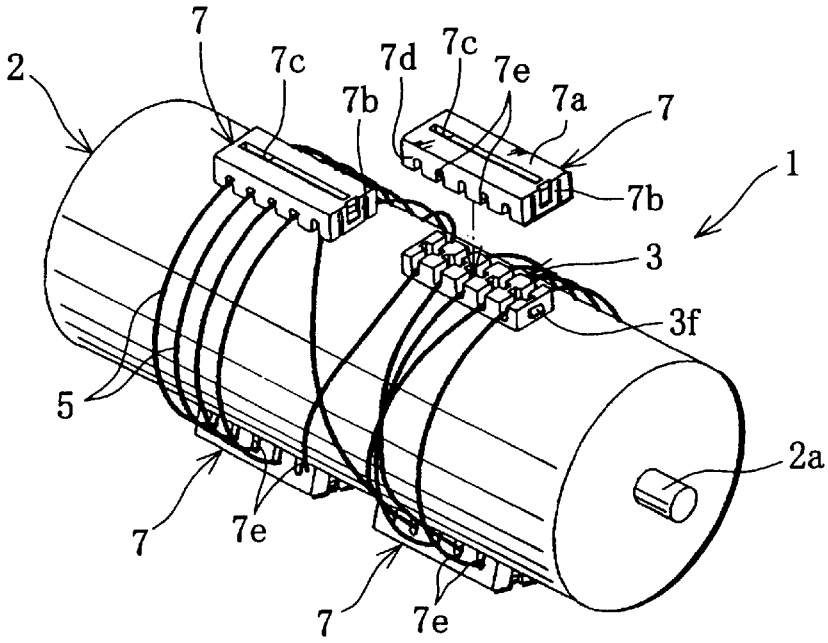
FIG. 12 is a perspective view showing a step of wiring an electric wire into a desired pattern using the wiring machine in FIG. 11 and how to attach a cover on the wire holding member after wiring.

In this case, the wire holding member 3 is provided with engagement projections 3*f* to catch an engagement piece 7*b*, as shown in FIG. 12, of the cover 7. Therefore, the wiring machine 1 forms a plurality of inserting sections 2*b* for inspection of the wire holding members 3 each in the shape that matches with the outline of the wire holding member 3, as shown in FIG. 11. As shown in FIG. 12, the cover 7 has engagement pieces 7*b* on both lengthwise sides of the body 7*a* and a slit 7*c* extending lengthwise. The cover 7 further has a plurality of recesses 7*a* formed in side walls 7*d* on both widthwise sides of the body 7*a* in association with the retaining grooves 3*b*.

As shown in FIG. 12, the wiring machine 1 winds the electric wire 5, fed out from the wiring head (not shown), around the wire winding body 2 in a one-stroke drawing style and moves the wiring head in the axial direction of the rotary shaft 2*a* to wire the electric wire 5 into a desired pattern by using the retaining grooves 3*b* of each wire holding member 3.

When wiring the electric wire 5 into a desired pattern by winding the electric wire 5 around the wire winding body 2 is completed, the cover 7 is attached to each wire holding member 3 as shown in FIG. 12, the electric wire 5 is cut at a desired position, e.g., in the vicinity of the wire holding members 3, and is removed from the wire winding body 2, thus yielding the wiring member 6.

Figure 13:
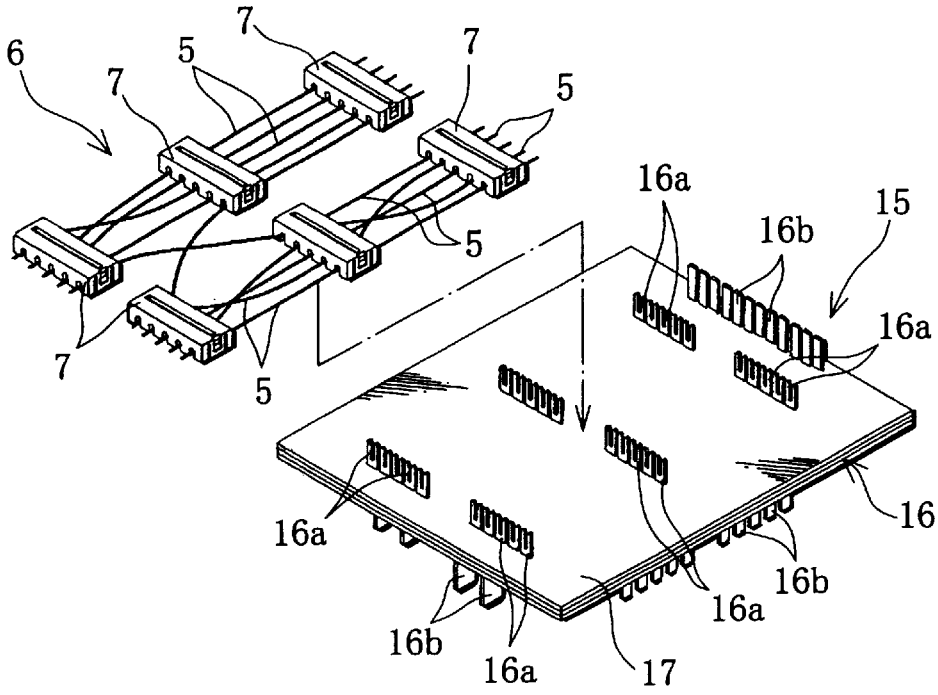
FIG. 13 is a perspective view showing how to attach a wiring member, acquired by cutting the electric wire into a desired pattern, at a desired position and removing the electric wire from a wire winding body, to a bus-bar wiring member.
Figure 14:
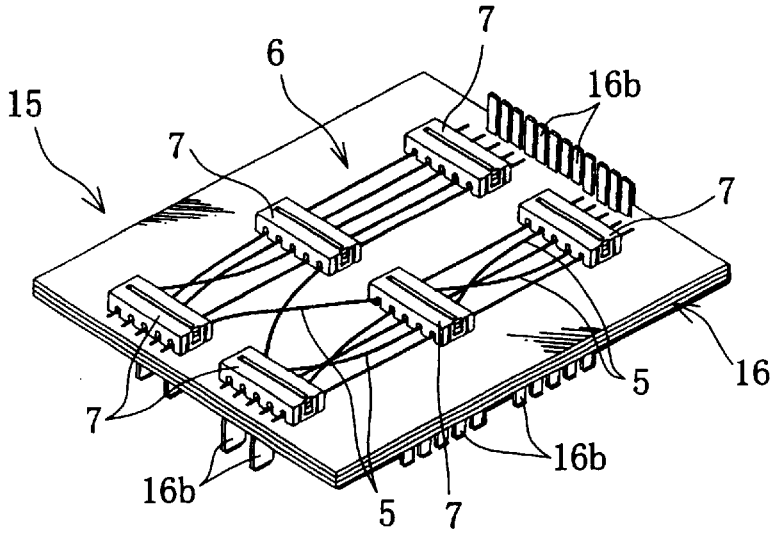
FIG. 14 is a perspective view depicting the wiring member in FIG. 13 attached to the bus-bar wiring member.

The wiring member 6 manufactured in this manner is attached to the bus-bar wiring member 15 at the respective pressure-contacting terminals 16*a*, as shown in FIG. 13. As a result, the individual pressure-contacting terminals 16*a* are fitted into the respective terminal grooves 3*c* of the wire holding members 3, causing the associated bus bars 16 to be connected together by the electric wires 5, so that the wiring member 6 is attached to the bus-bar wiring member 15, as shown in FIG. 14.

As the cover 7 is attached to each wire holding member 3 of the wiring member 6 at this time, the cover 7 prevents the electric wire 5 from lifting up and coming off the retaining groove 3*b* until the wiring member 6 is attached to the bus-bar wiring member 15. This facilitates the handling of the wiring member 6.

A description will now be given of another embodiment of the wiring-member manufacturing method of this invention which is designed to improve the working efficiency at the time of removing the wiring member from the wiring machine 1 and in consideration of preventing a contact between the bus bar and the electric wire.

Figure 15:
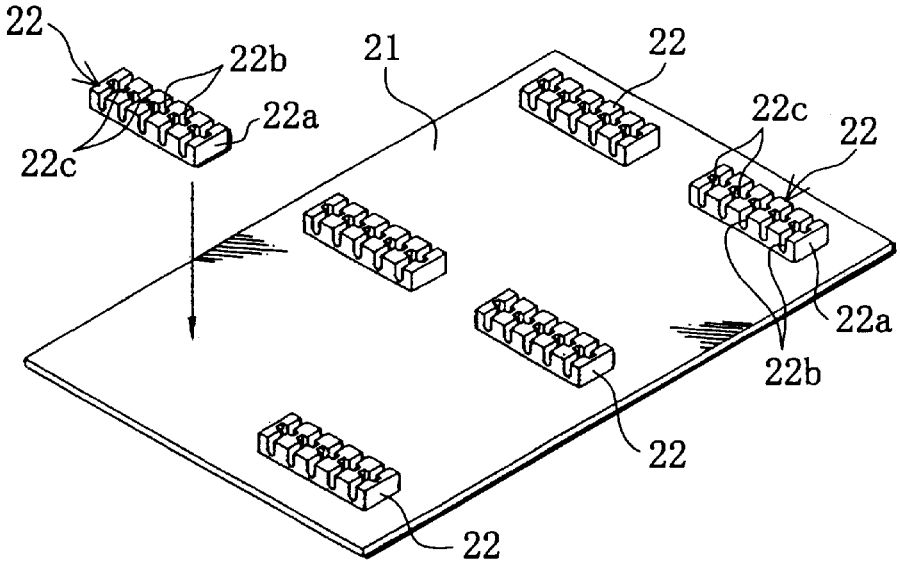
FIG. 15 is a perspective view illustrating a method of manufacturing a wiring member according to a further embodiment of this invention and a plurality of wire holding members attached to an insulating sheet.

First, as shown in FIG. 15, wire holding members 22 are attached to an insulating sheet 21 of a synthetic resin having a flexibility, such as PET (Polyethylene terephthalate) or vinyl chloride. The wire holding member 22 is constructed in approximately the same way as the wire holding member 3, has a plurality of retaining grooves 22*b* formed widthwise in a body 22*a* and a terminal groove 22*c* formed in the center and traversing the individual retaining grooves 22*b*.

Figure 16:
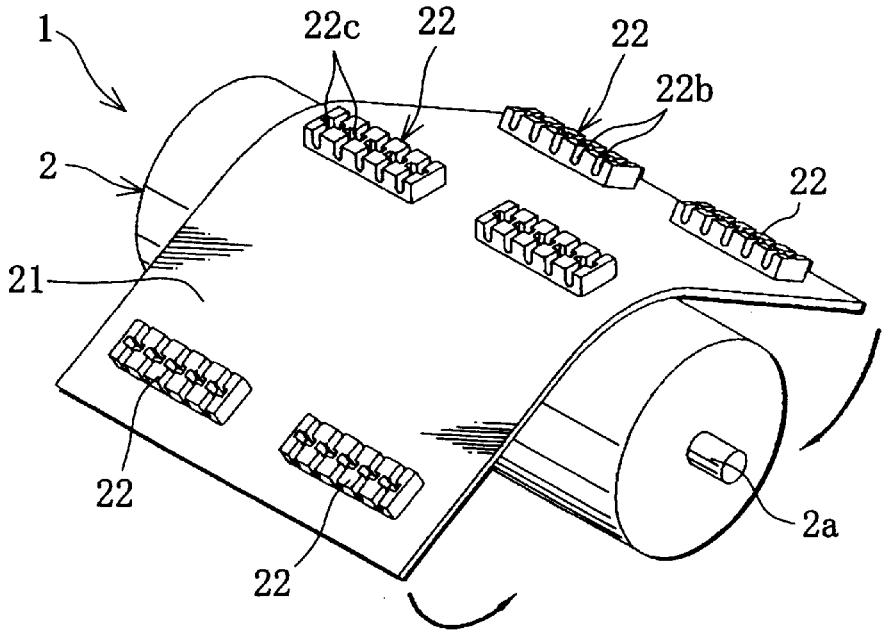
FIG. 16 is a perspective view showing how to secure the insulating sheet shown in FIG. 15 on a wiring machine.
Figure 17:
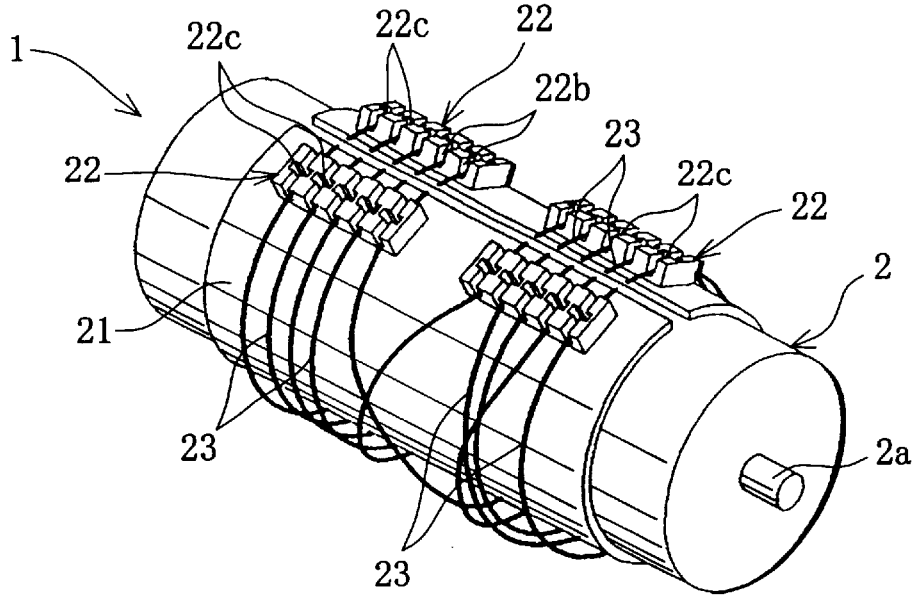
FIG. 17 is a perspective view showing an electric wire wired into a desired pattern and cut at a desired position by using the wiring machine on which the insulating sheet shown in FIG. 15 is secured.

Next, the insulating sheet 21 is put around the wire winding body 2 of the wiring machine 1 to be secured there as shown in FIG. 16. Then, after an electric wire 23 is wired into a desired pattern in the same manner as has been discussed earlier, the electric wire 23 is cut at a desired position, e.g., near the gap between both ends of the insulating sheet 21 as shown in FIG. 17 and is removed from the wire winding body 2, thus yielding a wiring member 20.

Apparently, this embodiment can also manufacture the wiring member 20 in a short period of time by using the wiring machine 1 having a simple structure, without requiring any special wiring plate, and can be easily adapted to a change in circuit design.

Figure 18:
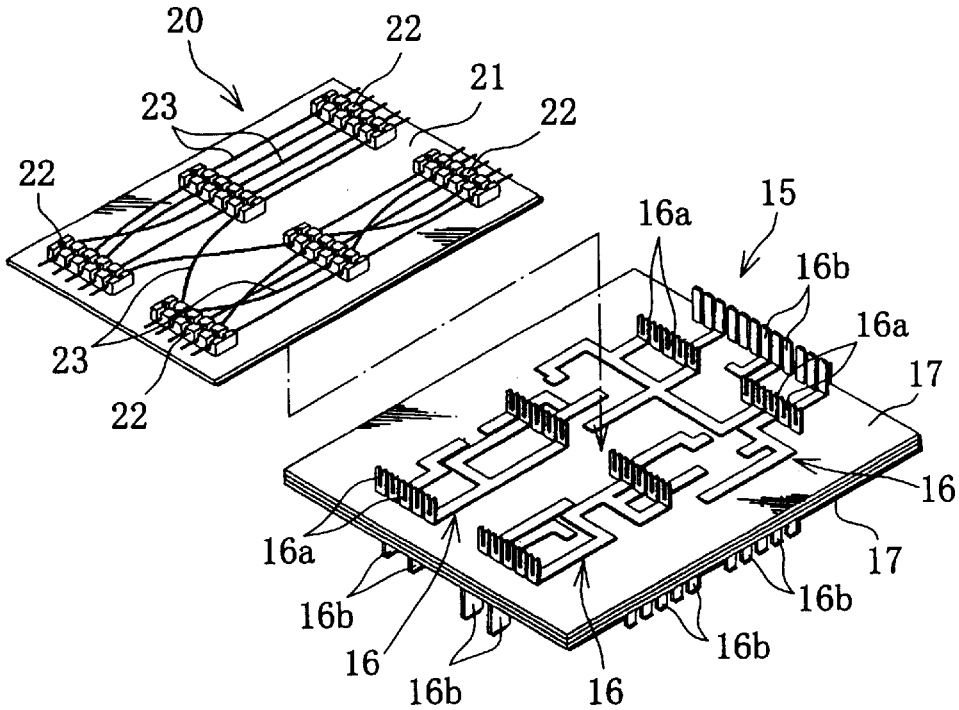
FIG. 18 is a perspective view showing how to attach a wiring member, acquired by removing the insulating sheet shown in FIG. 17 from the wiring machine, to a bus-bar wiring member.
Figure 19:
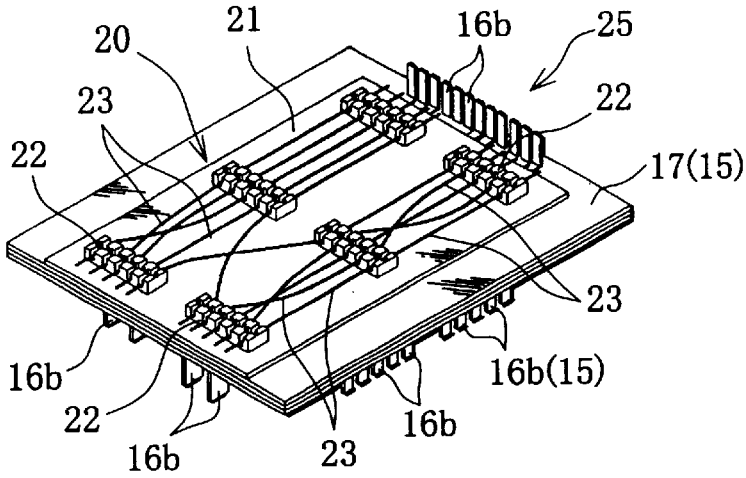
FIG. 19 is a perspective view depicting the wiring member shown in FIG. 18 attached to the bus-bar wiring member.

The wiring member 20 manufactured this way is attached to the bus-bar wiring member 15 which has a plurality of bus bars 16 and insulating plates 17 stacked together, as shown in FIG. 18. As a result, the individual pressure-contacting terminals 16*a* of the bus bars 16 are fitted into the respective terminal grooves 22*c* of the wire holding members 22, causing the associated bus bars 16 to be connected together by the electric wires 23, so that the wiring member 20 becomes a wiring board 25 as shown in FIG. 19.

Figure 20:
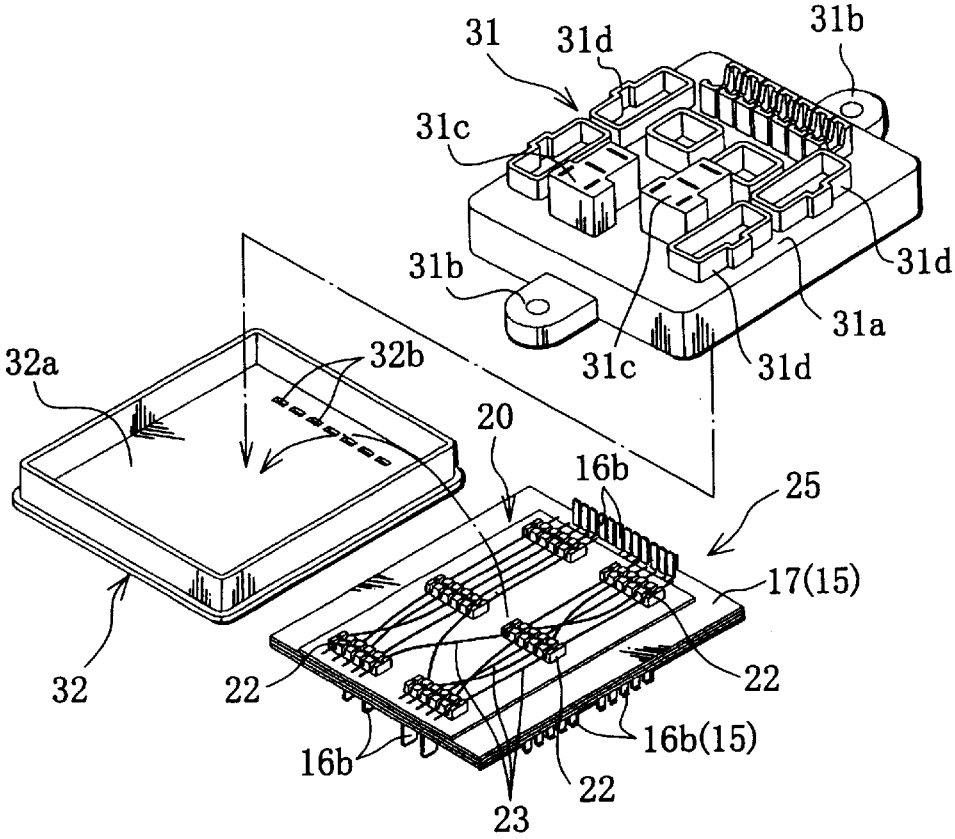
FIG. 20 is a perspective view illustrating how to construct an electric connection box of this invention by installing the wiring-member-attached bus-bar wiring member shown in FIG. 19 in the upper case and lower case.

Placing the thus manufactured wiring board 25 into an upper case 31 and a lower case 32 as shown in FIG. 20 can provide an electric connection box 30 which is simple and inexpensive and is easily adaptable to a change in circuit design.

The upper case 31 has attachment brackets 31*b* formed on both sides of a body 31*a*, mount sections 31*c* where various kinds of electric parts are mounted, and a connector housing 31*d* where a connector is attached.

The lower case 32, when fitted into the upper case 31, forms a box, and has a plurality of inserting holes 32*b* formed in a body 32*a* where the tab terminals 16*b* are to be inserted. As illustrated, the wiring board 25 is accommodated, turned over, in the lower case 32.

Figure 21:
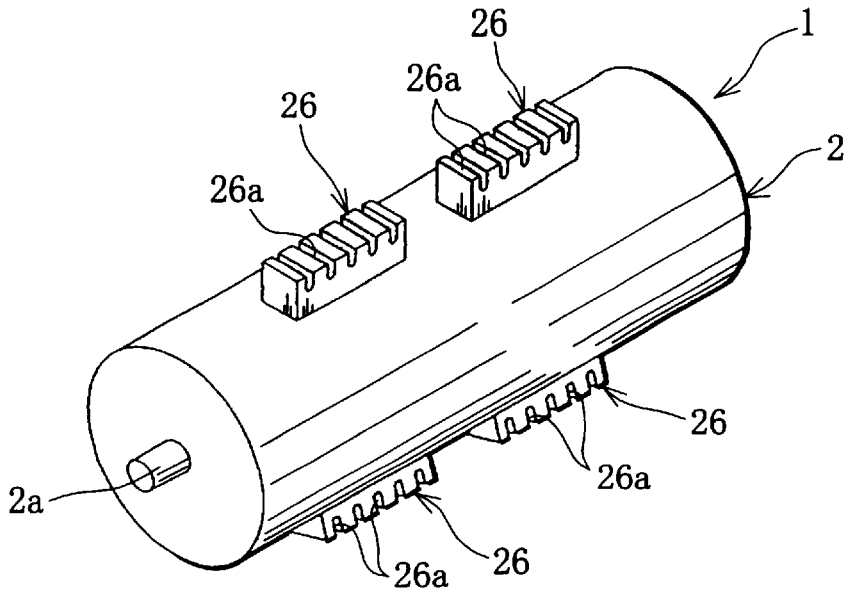
FIG. 21 is a perspective view illustrating a method of manufacturing a wiring member according to a still further embodiment of this invention and a wiring machine on which a plurality of wire holding members are attached.

Unlike the wiring member of the above-described embodiment, the wiring member that is designed to improve the working efficiency at the time of removing the wiring member from the wiring machine 1 and in consideration of preventing a contact between the bus bar and the electric wire may be manufactured in such a way that with a plurality of wire holding members 26 attached to the wire winding body 2 of the wiring machine 1 in advance as shown in FIG. 21, an insulating sheet 27 is put around the wire winding body 2 to be secured there.

As illustrated, each wire holding member 26 has a plurality of retaining grooves 26*a* formed in a body widthwise. The insulating sheet 27 has openings 27*a*, as shown in FIG. 22, formed at positions corresponding to the individual wire holding members 26.

Figure 22:
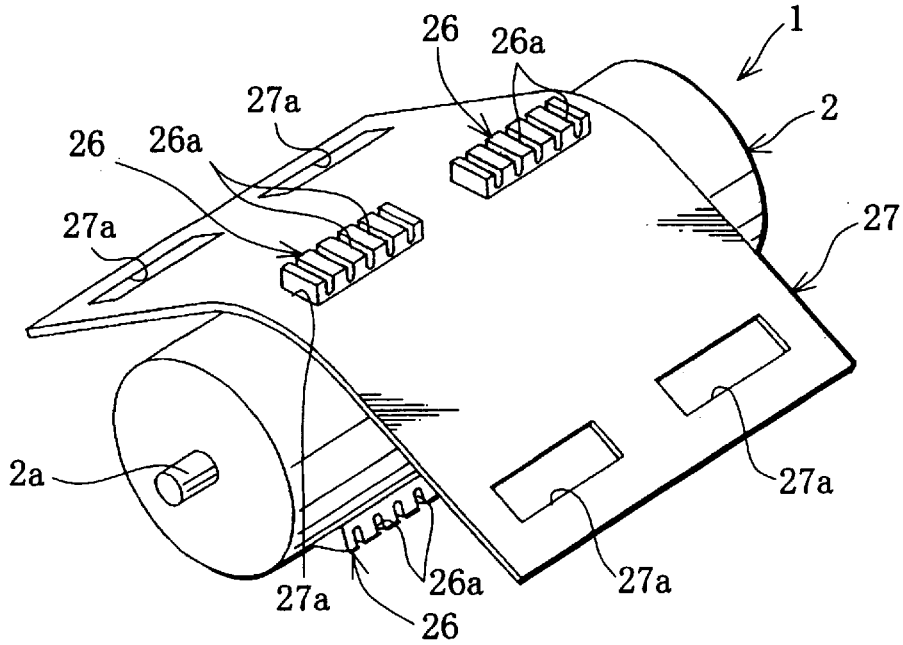
FIG. 22 is a perspective view showing how to secure an insulating sheet having openings formed at positions corresponding to a plurality of wire holding members on the wiring machine in FIG. 21.

In manufacturing a wiring member, first, the insulating sheet 27 is put around the wire winding body 2 to which the wire holding members 26 have been attached, as shown in FIG. 22. At this time, the individual wire holding members 26 protrude above the insulating sheet 27 through the openings 27*a*.

Figure 23A:
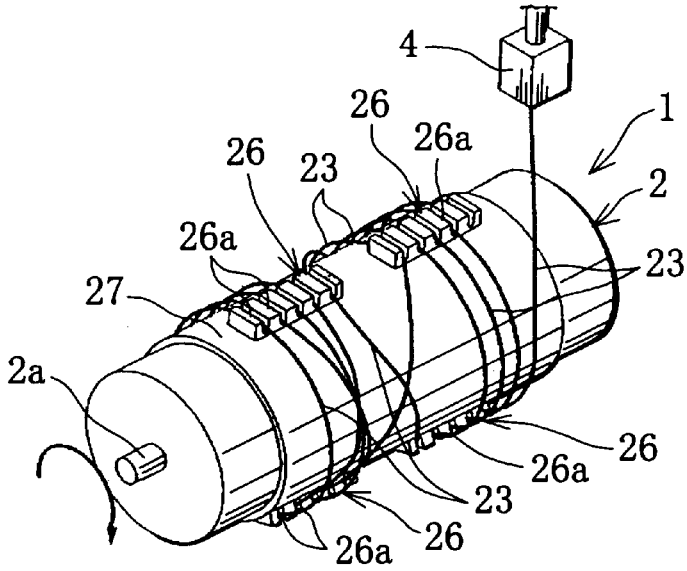
FIGS. 23A through 23C are perspective views depicting a plurality of steps of stacking insulating sheets and wiring an electric wire into a desired pattern.

Then, the electric wire 23 is fed out from the wiring head 4 while rotating the wire winding body 2 in the direction of the arrow as shown in FIG. 23A. Accordingly, the wiring machine 1 winds the electric wire 23, fed out from the wiring head 4, around the insulating sheet 27 in a one-stroke drawing fashion and wires the electric wire 23 into a desired pattern by using the retaining grooves 26*a* of each wire holding member 26 while moving the wiring head 4 in the axial direction of the rotary shaft 2*a*.

Figure 23B:
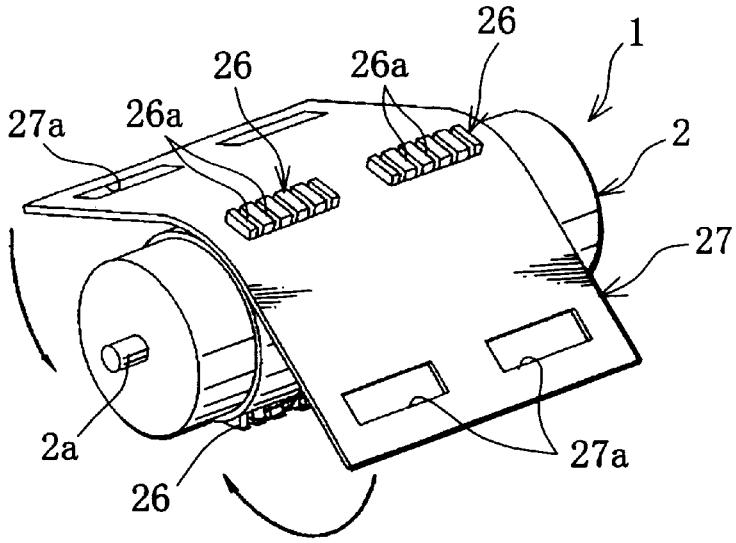

When wiring the electric wire 23 into a desired pattern is completed, the insulating sheet 27 is further put over the electric wire 23 as shown in FIG. 23B.

Figure 23C:
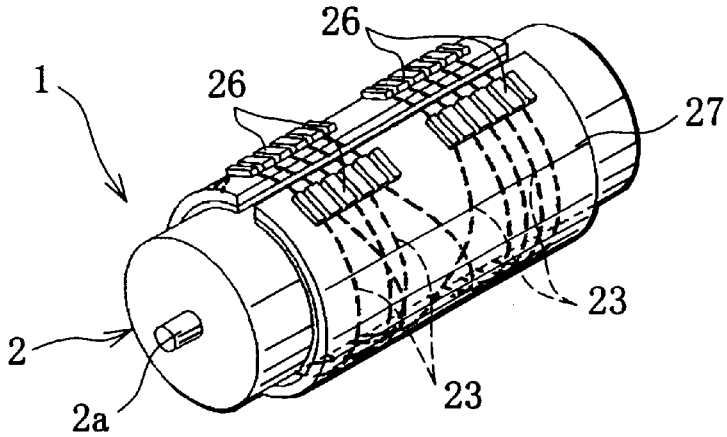

Then, the electric wire 23 is cut at a desired position, e.g., near the gap between both ends of the insulating sheet 27 as shown in FIG. 23C.

Figure 24:
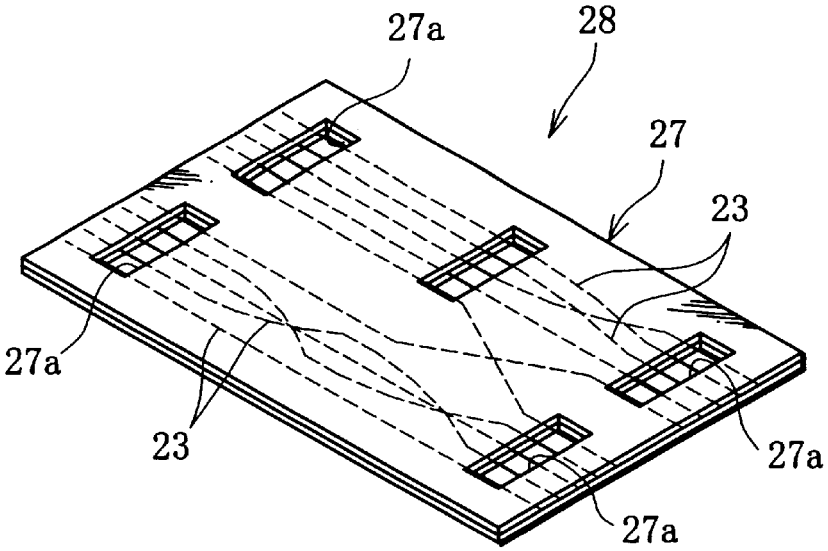
FIG. 24 is a perspective view showing wired electric wires removed together with the insulating sheets from the wiring machine.

Then, the electric wire 23 is removed together with the insulating sheets 27 from the wire winding body 2 and the wire holding members 26, thus yielding a wiring member 28 shown in FIG. 24 which has the electric wire 23 wired into the desired pattern. This wiring-member manufacturing method of this embodiment therefore facilitates the removal of the wiring member from the wiring machine 1, thus resulting in an improved working efficiency and preventing a contact between the bus bar and the electric wire.

The wiring member 28 manufactured this way is attached to an unillustrated bus-bar wiring member in the same way as has been discussed above, and the associated bus bars are connected together by the electric wires 23, thus yielding a wiring board. As this wiring board is placed in a case, an electric connection box is completed.

Figure 25:
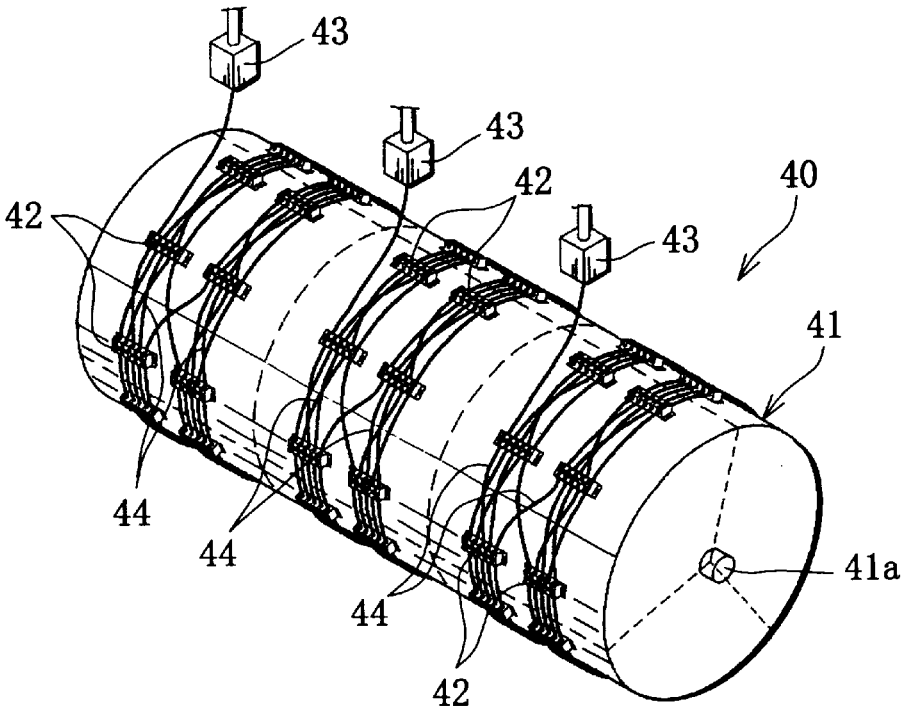
FIG. 25 is a perspective view illustrating a method of manufacturing a wiring member according to a still yet further embodiment of this invention and a wiring machine for manufacturing a plurality of wiring members simultaneously.

To ensure manufacture of a plurality of wiring members simultaneously, the wiring machine to which the wiring-member manufacturing method of this invention is adapted may be modified like a wiring machine 40 shown in FIG. 25. A wire winding body 41 having a rotary shaft 41*a* has a larger diameter or is made longer so that multiple wire holding members 42 can be attached to the wire winding body 41 and a plurality of wiring heads 43 are provided in association with the wire holding members 42 to wire electric wires 44 in desired patterns. The wire winding body 41 may be comprised of a plurality of separate components which can be assembled closer to or apart from one another in the radial direction so that the diameter of the wire winding body 41 can be altered as needed.

Figure 26:
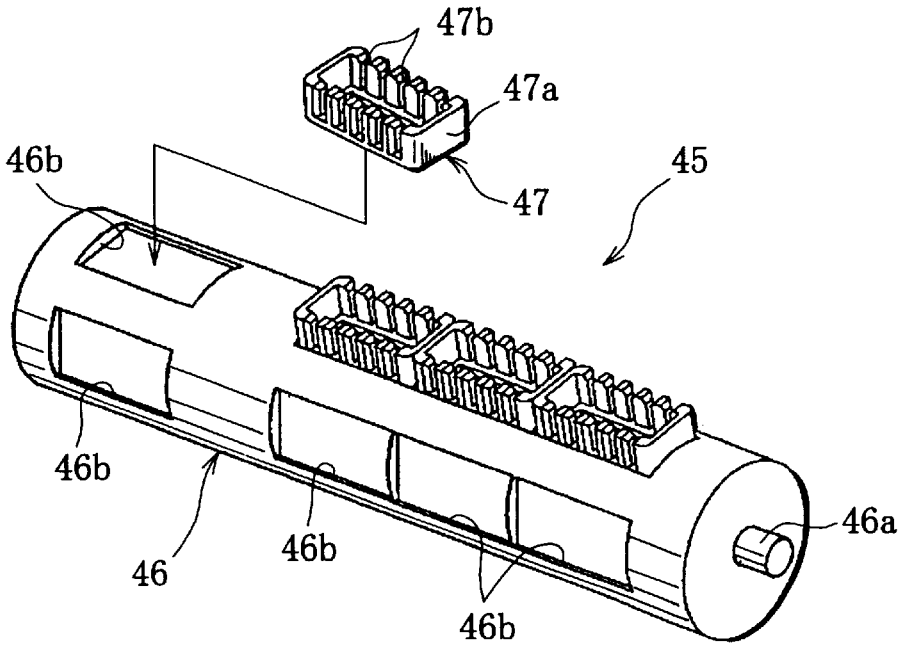
FIG. 26 is a perspective view illustrating the schematic structure of another wiring machine to which the method of manufacturing a wiring member according to this invention is adapted.
Figure 27:
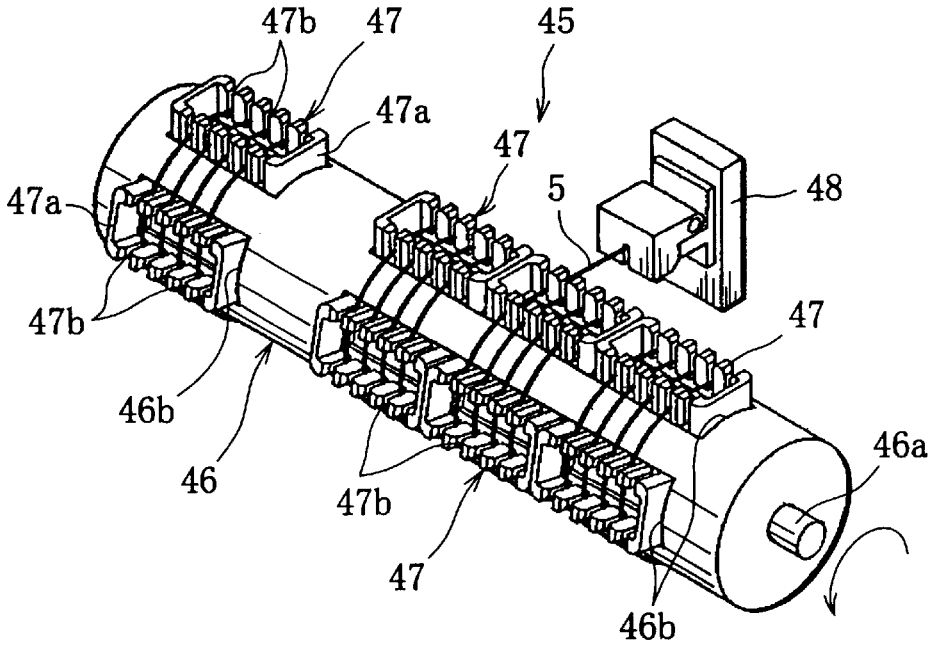
FIG. 27 is a perspective view showing a step of wiring an electric wire into a desired pattern using the wiring machine in FIG. 26.

The wiring member may be manufactured by using a wiring machine 45 embodying this invention which will be discussed below. As shown in FIGS. 26 and 27, the wiring machine 45 has a wire winding body 46, a wiring head 48 and a pressing head 54, all of which will be discussed later. The rotation of the wire winding body 46, and the operations of the wiring head 48, the pressing head 54 and so forth are controlled by unillustrated control means.

The wire winding body 46 has a rotary shaft 46*a* and a plurality of inserting section 46*b* formed therein for insertion of wire holding members 47. The wire winding body 46 is rotated about the rotary shaft 46*a* in the direction of the arrow in FIG. 27 by unillustrated drive means. It is to be noted that the wire winding body 46 can rotate in the reverse direction at a desired position to wire the electric wire 5 in a U form depending on the circuit pattern.

First, as shown in FIG. 26, the wire holding members 47 are inserted in the respective inserting sections 46*b* of the wire winding body 46. Each wire holding member 47 has a plurality of retaining grooves 47*b* formed in a body 47*a* and an opening 47*c* formed in the bottom surface.

Next, the electric wire 5 is fed out from the wiring head 48 while rotating the wire winding body 46 in the direction of the arrow as shown in FIG. 27. Accordingly, the wiring machine 45 winds the electric wire 5, fed out from the wiring head 48, around the wire winding body 46 in a one-stroke drawing fashion and wires the electric wire 5 into a desired pattern by retaining the electric wire by using the retaining grooves 47*b* of each wire holding member 47 while moving the wiring head 48 in the axial direction of the rotary shaft 46*a* of the wire winding body 46.

Figure 28:
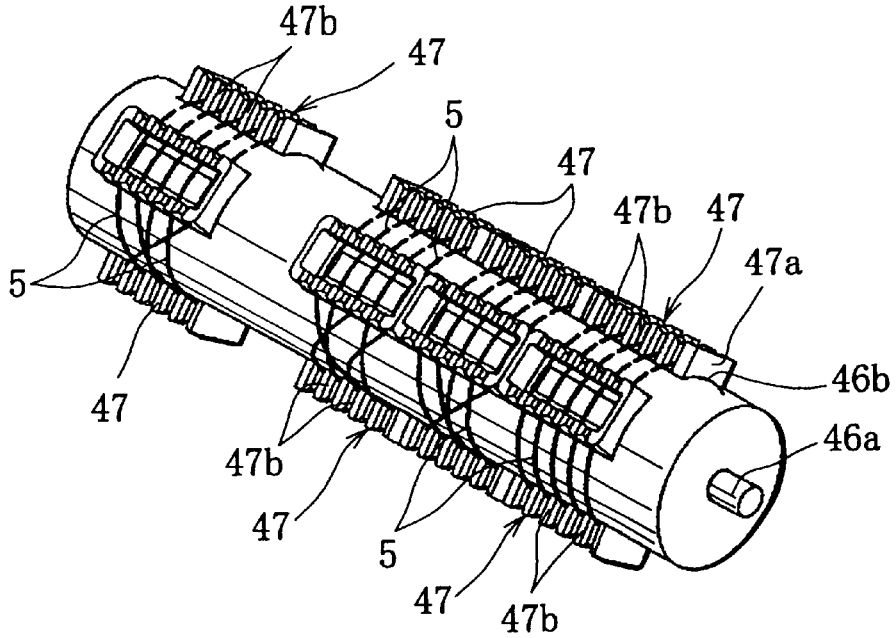
FIG. 28 is a perspective view showing a step of cutting the electric wire, wired into the desired pattern, at a desired position using the wiring machine in FIG. 26.

When wiring the electric wire 5 into a desired pattern by winding the electric wire 5 around the wire winding body 46 is completed, the electric wire 5 is cut at a proper position in the vicinity of the wire holding members 47 as shown in FIG. 28.

Figure 29:
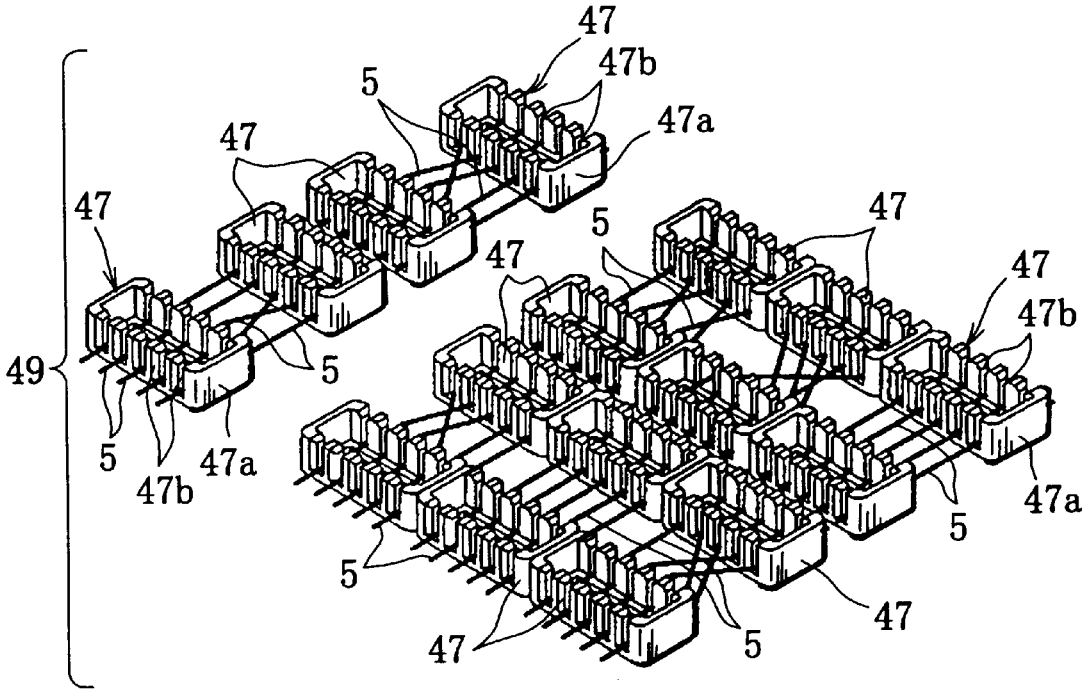
FIG. 29 is a perspective view showing the precursor of a wiring member which is manufactured through a step of cutting the electric wire at a desired position and removing the electric wire from a wire winding body.

Then, removing the electric wire 5 together with the wire holding members 47 from the wire winding body 46 yields a precursor 49 of a wiring member which has the electric wire 5 wired into a desired pattern, as shown in FIG. 29.

Figure 30:
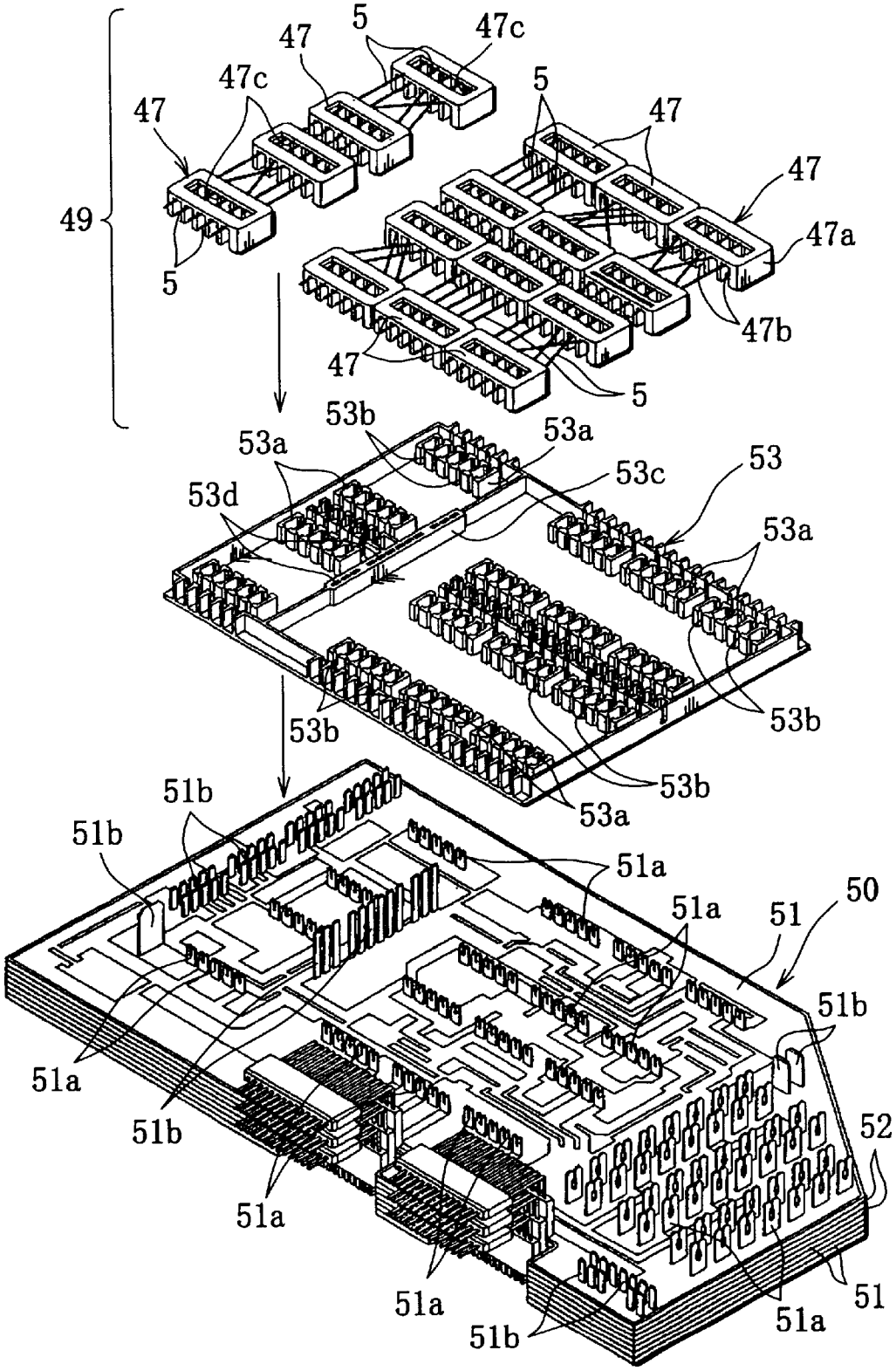
FIG. 30 is a perspective view showing how to attach the precursor of a wiring member to a bus-bar wiring member via an insulating plate.

Then, the precursor 49 is turned over from the state shown in FIG. 29 and is attached to a bus-bar wiring member 50 via an insulating spacer 53 as shown in FIG. 30.

The bus-bar wiring member 50, like the bus-bar wiring member 15, has a plurality of bus bars 51 and insulating plates 52 alternately stacked. The bus bar 51 has a plurality of pressure-contacting terminals 51*a* and tab terminals 51*b* protruding at proper locations. The insulating plate 52 has inserting holes (not shown) at positions corresponding to the pressure-contacting terminals 51*a* and tab terminals 51*b*, so that the pressure-contacting terminals 51*a* and tab terminals 51*b*, inserted through the inserting holes, protrude from the top and bottom surfaces of the bus-bar wiring member 50. As illustrated, the insulating spacer 53 has a plurality of inserting sections 53*a* formed in a rectangular cylindrical shape and a rib-like inserting section 53*c* provided on the plate surface. The pressure-contacting terminals 51*a* are to be inserted into the respective inserting section 53*a*. Each inserting section 53*a* has a holding groove 53*b* formed therein, and the inserting section 53*c* has a plurality of inserting holes 53*d* formed therein where the tab terminals 51*b* are to be inserted.

Figure 31:
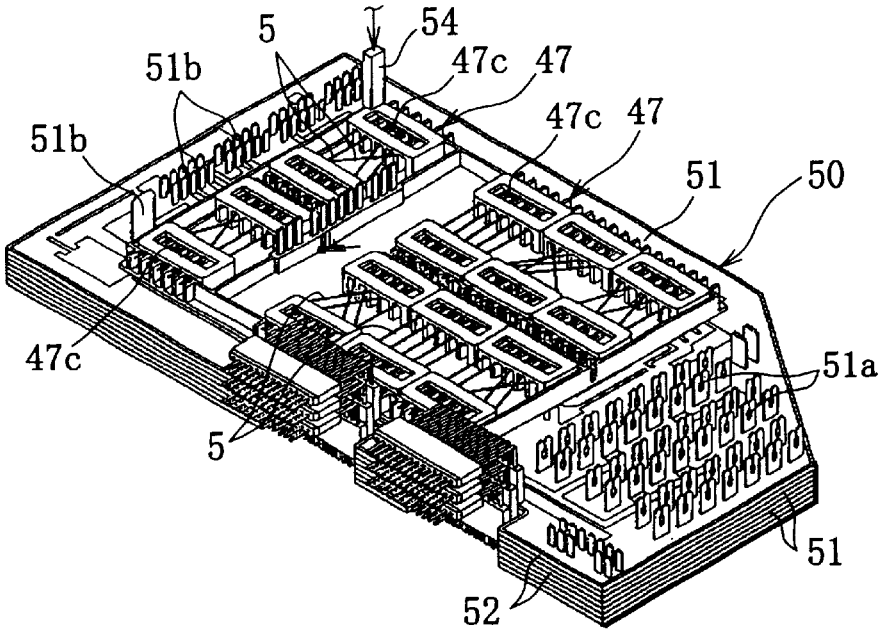
FIG. 31 is a perspective view showing the precursor of the wiring member attached to the bus-bar wiring member via the insulating plate.

The precursor 49 of the wiring member is attached to the bus-bar wiring member 50 via the insulating spacer 53 as shown in FIG. 31. Under this situation, as illustrated, the pressing head 54 is moved down from above to press the electric wire 5 held in the retaining grooves 47*b* of each wire holding member 47 through the opening 47*c*. As a result, the pressing head 54 separates the electric wire 5 from the wire holding member 47 and holds the electric wire 5 into the holding groove 53*b* of the associated inserting section 53*a*.

Figure 32:
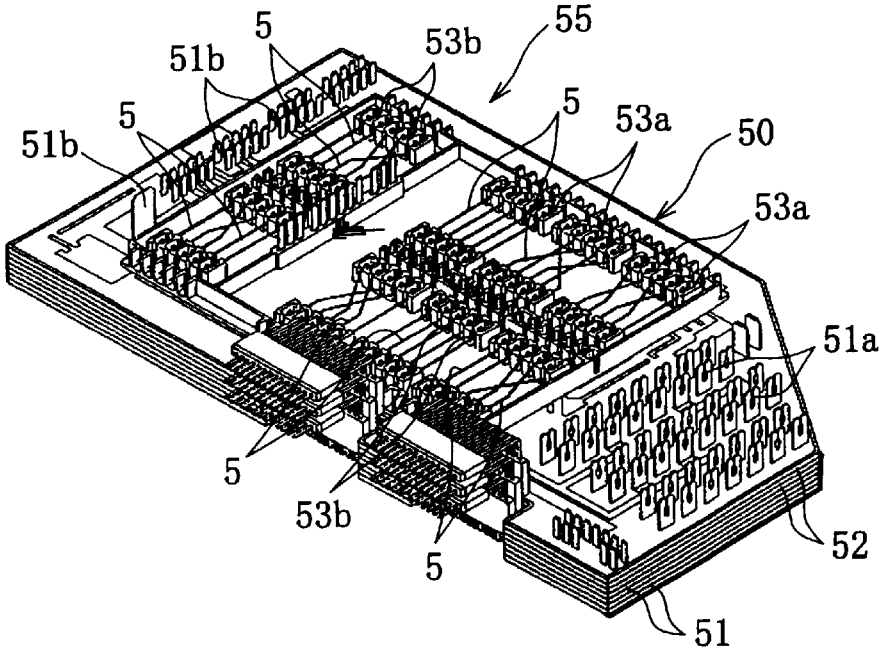
FIG. 32 is a perspective view of a wiring member acquired by removing wire holding members from the bus-bar wiring member in FIG. 31.

After the electric wires 5 are moved to the holding grooves 53*b* of the insulating spacer 53 from all the wire holding members 47, only the wire holding members 47 are removed from the bus-bar wiring member 50, yielding a wiring member 55 as shown in FIG. 32.

As the wiring member 55 is manufactured by using the wiring machine 45 having a simple structure embodying this invention, the wiring member 55 can be produced in a short period of time without requiring any special wiring plate, and can be easily adapted to a change in circuit design.

Figure 33:
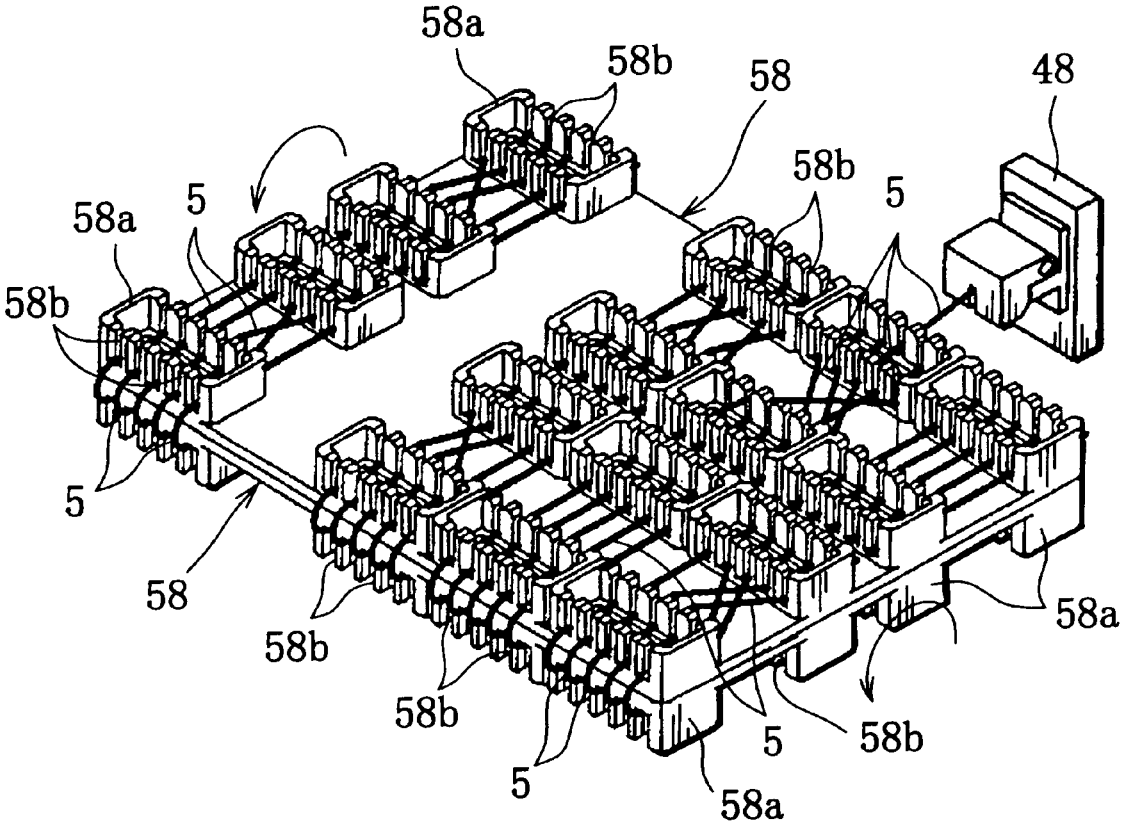
FIG. 33 is a perspective view illustrating another method of manufacturing a wiring member using a wire holding plate.
Figure 34:
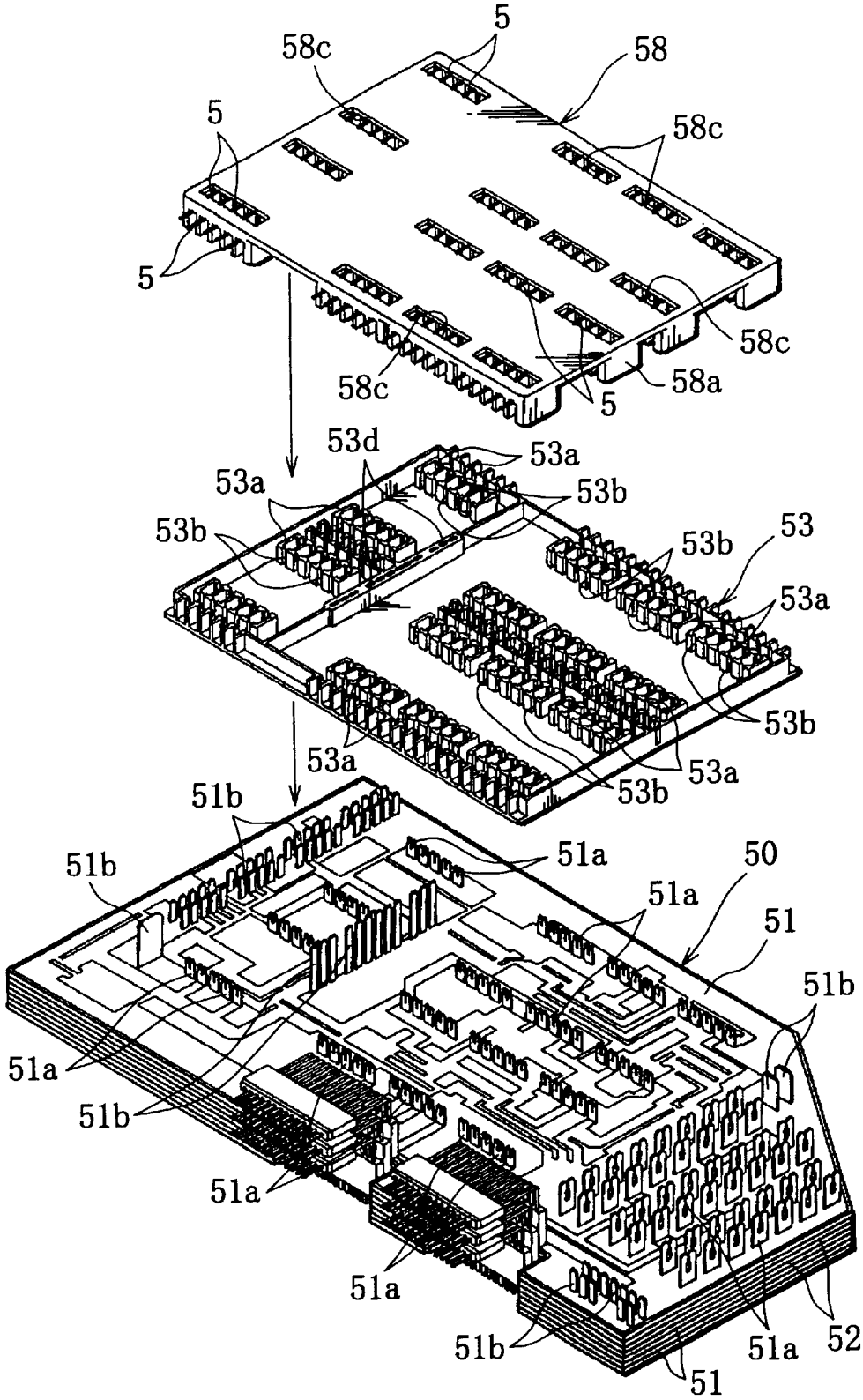
FIG. 34 is a perspective view showing how to attach the wire holding plate shown in FIG. 33 to a bus-bar wiring member via an insulating plate.

As shown in FIG. 33, a wiring member may be manufactured by using two wire holding plates 58 put together, each having a plurality of wire holding sections 58*a* each of which has the same structure as the wire holding member 47 shown in FIG. 30 and has a plurality of retaining grooves 58*b* formed in each wire holding section 58*a* for retaining the electric wire 5 and an opening 58*c* (see FIG. 34) formed in the bottom surface.

While the two wire holding plates 58 put together is rotated in the direction of the arrow, the wiring head 48 is moved to wire the electric wire 5 into a desired pattern as shown in FIG. 33. When wiring the electric wire 5 is completed, the electric wire 5 is cut at the edge portions of the wire holding plates 58 or at proper positions, so that the two wire holding plates 58 are separated from each other. This method can allow two wire holding plates 58 to be wired with the electric wire in a single wiring work, thus shortening the overall time needed to manufacture a wiring member.

Thereafter, each wire holding plate 58 is turned over and is attached to the bus-bar wiring member 50 via the insulating spacer 53 in the same way as discussed previously. Then, the electric wire 5 is removed from each wire holding section 58*a* and is held into the holding groove 53*b* of the associated inserting section 53*c* by using the pressing head 54, thereby separating the wire holding plate 58 from the bus-bar wiring member 50. This method can manufacture the wiring member 55 shown in FIG. 32 faster.

According to the wiring-member manufacturing method of this invention, wiring may be accomplished by fixing the wire winding body 2, 41 or 46, or the wire holding plates 58 and moving the wiring machine and thus the electric wire side to wind the electric wire around the wire winding body 2, 41 or 46, or the wire holding plates 58.

What is claimed is:

1. A method of manufacturing a wiring member, said method comprising the steps of:

winding and crossing a single continuous electric wire a plurality of times around a wire winding body having a plurality of wire holding members arranged thereon so as to form a predetermined pattern, said wire holding members comprising a plurality of wire retaining sections;

cutting said single continuous electric wire at a predetermined position to form said wiring member, said wiring member including said plurality of wire holding members connected by connecting wires, with at least two of said connecting wires crossing each other; and removing said wiring member from said wire winding body.

2. The method according to claim 1, wherein said winding step comprises:

rotating said wire winding body on a rotary shaft having a plurality of inserting sections each configured to hold one of said wire holding members.

3. The method according to claim 1, wherein said winding step comprises:

wiring said single continuous electric wire into a plurality of retaining grooves.

4. The method according to claim 2, wherein said winding step comprises:

wiring said single continuous electric wire into a plurality of retaining grooves.

5. The method according to claim 3, wherein each of said wire holding members comprises:

a terminal groove formed in a direction perpendicular to a layout direction of said plurality of retaining grooves.

6. The method according to claim 4, wherein each of said wire holding members comprises:

a terminal groove formed in a direction perpendicular to a layout direction of said plurality of retaining grooves.

* * * * *

UNITED STATES PATENT AND TRADEMARK OFFICE

CERTIFICATE OF CORRECTION

PATENT NO. : 6,732,430 B1
DATED : May 11, 2004
INVENTOR(S) : Murakami et al.

It is certified that error appears in the above-identified patent and that said Letters Patent is hereby corrected as shown below:

Title page, Item [54] and Column 1, lines 1-3,
Title should read: -- METHOD OF MANUFACTURING WIRING MEMBER USING SINGLE CONTINUOUS WIRE WOUND PLURAL TIMES AROUND WIRE WINDING BODY --

Signed and Sealed this

Thirteenth Day of July, 2004

JON W. DUDAS
*Acting Director of the United States Patent and Trademark Office*